US005860165A

United States Patent [19]

Cvijanovich

[11] Patent Number: 5,860,165

[45] Date of Patent: Jan. 19, 1999

[54] CONCEALED COMPARTMENT INCORPORATED INTO HEAD GEAR

[76] Inventor: Stefan Cvijanovich, 1965 Offshore, Oxnard, Calif. 93030

[21] Appl. No.: 828,397

[22] Filed: Mar. 28, 1997

[51] Int. Cl.[6] ..... A42B 1/06

[52] U.S. Cl. ..... 2/195.1; 2/209.13; 2/172

[58] Field of Search ..... 2/171.2, 171.4, 2/171.5, 171.6, 171.7, 172, 181, 181.4, 209.11, 209.12, 209.13, 209.14, 175.6, 195.1

[56] References Cited

U.S. PATENT DOCUMENTS

| | | | |
|---|---|---|---|
| 1,255,481 | 2/1918 | Spranger . | |
| 1,613,675 | 1/1927 | Peedie | 2/209.14 X |
| 1,764,483 | 6/1930 | Watkins . | |
| 1,990,096 | 2/1935 | Rothchild | 2/171.7 X |
| 2,106,571 | 1/1938 | Lipton | 2/171.7 X |
| 3,166,766 | 1/1965 | Banello | 2/175.6 |
| 3,438,062 | 4/1969 | Dobell . | |
| 3,496,575 | 2/1970 | Nekermann et al. | 2/209.14 X |
| 3,611,444 | 10/1971 | Rector . | |
| 3,840,901 | 10/1974 | Eyster . | |
| 4,266,300 | 5/1981 | Partridge . | |
| 4,602,390 | 7/1986 | Morera et al. . | |
| 4,651,355 | 3/1987 | White . | |
| 4,899,395 | 2/1990 | Spector . | |
| 5,005,374 | 4/1991 | Spitler | 2/171.2 X |
| 5,146,630 | 9/1992 | Richard | 2/171.2 X |
| 5,327,585 | 7/1994 | Karlan | 2/171.2 |
| 5,465,425 | 11/1995 | Crispin . | |
| 5,539,929 | 7/1996 | Revson | 2/209.13 X |
| 5,649,327 | 7/1997 | Crewe | 2/172 |
| 5,664,257 | 9/1997 | Hall | 2/209.11 X |
| 5,669,075 | 9/1997 | Weeks | 2/195.1 X |

*Primary Examiner*—Michael A. Neas
*Assistant Examiner*—Shirra L. Jenkins
*Attorney, Agent, or Firm*—W.D. English; Milord Keshishzadeh, J.D.

[57] ABSTRACT

A secret compartment on headgear for concealing small valuable items which is only know and accessible by the wearer. The compartment is composed of a piece of material which is inwardly folded upon itself creating overlapping portions, and the overlapping portions are peripherally attached. The inner piece of material has an opening slit to allow input of items and a closing mechanism to prevent inadvertent opening and loss of the item. The compartment is attached to headgear such as, but not limited to, caps, hats, and headbands.

1 Claim, 2 Drawing Sheets

CONCEALED COMPARTMENT INCORPORATED INTO HEAD GEAR

FIELD OF INVENTION

This invention relates to a secret compartment on headgear, for concealing small valuable items, which is only known and accessible by the wearer.

DISCUSSION OF THE PRIOR ART

While clothing pockets are now commonplace, the invention of such pockets was followed by pickpockets and the more violent robbers who use physical violence to strip the victim's pockets. It is because of the danger of theft that many articles of clothing today include hidden pockets which are not only inaccessible to thieves but also the wearer of these articles themselves.

The prior art includes attachable pockets which can be adhered to the inner surface of a garment or undergarment. The location of these pockets, however, makes it inaccessible to the wearer because the garments need to be removed before the pockets can be reached. Thus it can be an embarrassment and an inconvenience to reach into undergarments or the inner surface of garments to obtain the valuables. In addition, it may be difficult to know if the pockets have become detached and have fallen off.

The prior art also includes "money belts" which are designed to provide a secret pocket within a belt. However, such belts cannot be worn with certain outfits such as exercise clothing and swim-wear. In addition, it is inconvenient to take off a belt to access the compartment because the belt's functional purpose of holding clothing in place will be disturbed. Furthermore, belts are narrow and can only store folding money and cannot accommodate credit cards, a driver license, or valuable objects such as a ring.

Therefore, the need exists for a secret pocket that can be placed on head gear allowing convenient and exclusive access to the wearer. In addition, the need exists for storing valuables in the secret pocket of headgear while engaged in sports or attending the beach.

OBJECTS OF THE INVENTION

In view of the foregoing, the main object of this invention is to provide a self-sufficient pocket on headgear for conveniently concealing valuables, such as, but not limited to, a credit card, license, money, keys, or rings.

Another object of this invention is to allow the concealing of small valuable items which are only known to and conveniently accessible to the wearer of the headgear.

Another object of this invention is to allow the storage of small valuable items while the wearer is engaged in sports or out of doors activities such as the beach, where typical apparel do not have storage pockets.

Another object of this invention is to allow the storage of small valuable items where the wearer is aware of their location and can easily determine if the storage compartment has fallen off.

Another object of this invention is to provide a secret pocket formed of low-cost, soft, fabric-like material that is sturdy, and is comfortable to wear.

Other objects and advantages of the invention herein will become more apparent from a description of the invention which follows.

DESCRIPTION OF THE INVENTION

Figure 1:
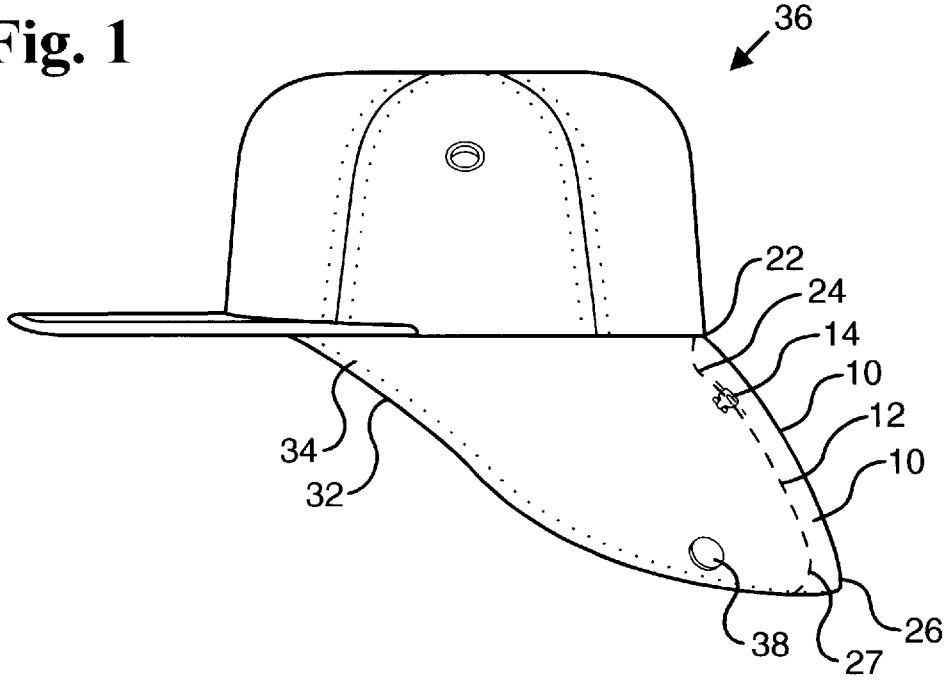
FIG. 1 is an elevational side view of the pocket mounted on a cap.
Figure 2:
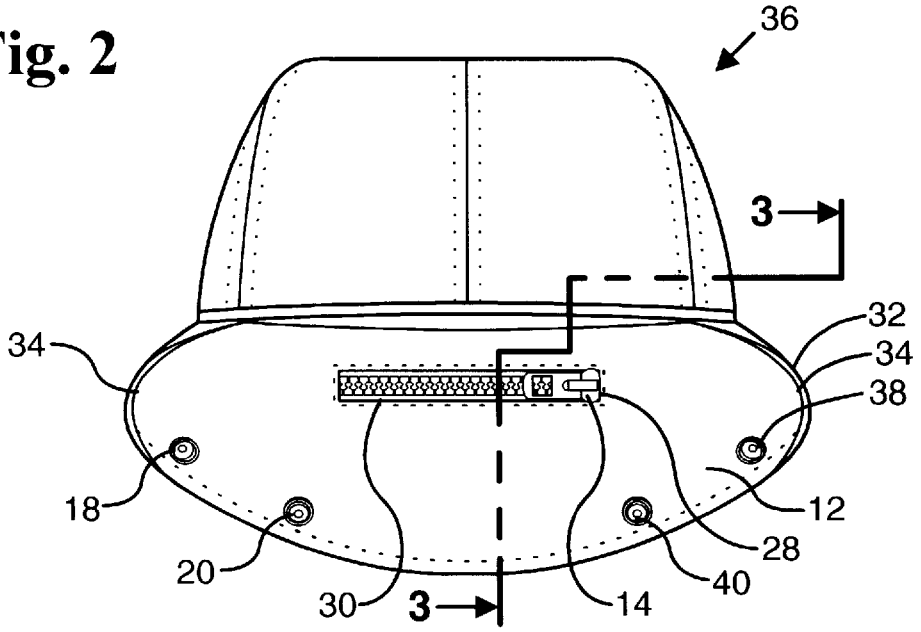
FIG. 2 is an elevational front view of the cap with the pocket mounted on the distal end.
Figure 3:
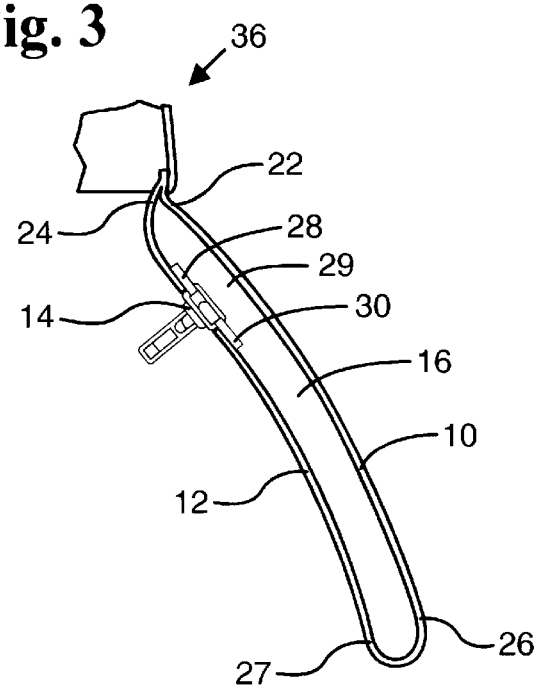
FIG. 3 is a cross-sectional view of the pocket which is taken in the plane indicated by line 3—3 in FIG. 2.

Referring now to FIGS. 1 to 3, a concealed storage compartment 16 is incorporated into the bottom of the cranial portion 36 of a cap or headgear, headgear may be obtained from "duck cloth." Although a cap is illustrated in the figures, other types of head gear such as any type of hat, bonnet, hood, yarmulke, helmet, or headband may be substituted. Cranial portion 36 of the cap is attached to an outer layer 10 of material marginally sealed to an inner layer 12 of material at a right side 34 of both materials and a left side 32 of both materials, and also sealed at a top portion 22 of outer layer 10 of material to a top portion 24 of inner layer 12 of material. A bottom portion of the compartment 16 can either be formed by a continuous layer of material having a bottom portion 26 of outer layer 10 of material turning inwards to form a bottom portion 27 of inner layer 12 of material, or the bottom portion 26 of the outer layer 10 of material can be attached to the bottom portion 27 of the inner layer 12 of material at their respective margins. Compartment 16 can be removably attached to cranial portion 36 by an attaching means 50 adhered to either outer layer 10 or inner layer 12. Attaching means 50 may be selected from any attaching means well known in the art such as a hook and loop fasteners. In addition, both outer layer 10 or inner layer 12 may be individually or cooperatively joined to cranial portion 36.

Compartment 16 is accessible through an upper portion 28 of an opening 29 and a lower portion 30 of opening 29. A fastening means 14 of opening 29 is employed to attach upper portion 28 of opening 29 to lower portion 30 of opening 29. Although a zipper mechanism is employed as the fastening means 14 of opening 29 in the figures, other mechanisms for closing the opening 29 can be utilized, such as VELCRO® (hook and loop fastener), buttons, drawstring mechanism, a stud mechanism, or a pin. In addition to the horizontal opening demonstrated in the figures, alternatives such as vertical openings are also available. Opening 29 can either be defined by outer layer 10 or inner layer 12. Opening 29 can also be created by not joining inner layer 12 and outer layer 10 along at least one of their edges. After compartment 16 is loaded with an item which may be a credit card, money, or a driver license, the opening is then closed by the fastening means 14 of opening 29 to prevent the item from being lost.

To prevent excessive movement of compartment 16 during physical activity, a right male component 20 of attaching mechanism is inserted into a right female component 18 of attaching mechanism. Respectively, a left male component 40 of attaching mechanism is inserted into a left female component 38 of attaching mechanism. Although a stud attaching mechanism is demonstrated in the figures, other attaching mechanisms may be employed without departing from the essence of the invention.

Figure 3A:
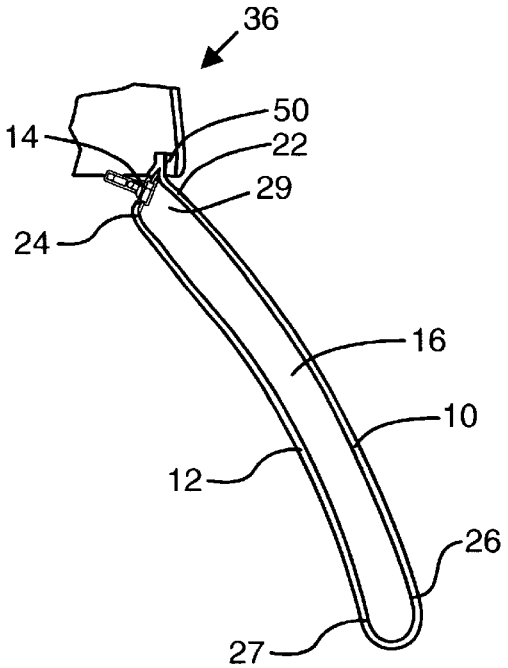
FIG. 3A is a cross-sectional view of the pocket, taken in the plane indicated by line 3—3 in FIG. 2, showing a fastening means of opening joining an unjoined edge of an inner layer and outer layer, and also showing an attaching means which makes the pocket removably attachable to an article of headgear.
Figure 3B:
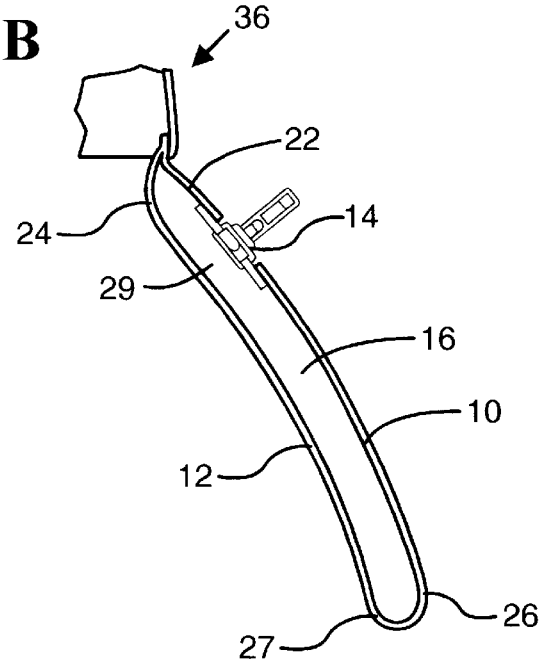
FIG. 3B is a cross-sectional view of the pocket, taken in the plane indicated by line 3—3 in FIG. 2, showing a pocket joined to an article of headgear by an inner layer, and also showing a fastening means for an opening defined by an outer layer.

While my above description contains many specificities, these should not be construed as limitations on the scope of the invention, but rather as an exemplification of one preferred embodiment thereof. Many other variations are possible. For example the compartment 16 may be built into the inner surface of the cranial portion of the headgear itself, the compartment may be independent and removably attachable to the headgear (such as at 50 of FIG. 3A), the compartment may be changed in size, made of a different material, made of a different shape, made of a different color, made integrally or separately, connected or associated with its adjacent elements in a different manner, or given a different mode or function of operation without departing from the essential spirit of this invention. Accordingly, the scope of the invention should be determined not by the embodiment illustrated, but by the appended claims and their legal equivalents.

I claim:

1. A covert compartment on headgear, comprising:

a compartment disposed in and upon an article of headgear, said compartment having a covertly located opening, said opening having a fastening means for temporarily closing said opening;

said compartment has an outer layer of material, said outer layer of material having a top portion of outer layer of material, a bottom portion of outer layer of material, a right side of outer layer of material, and a left side of outer layer of material, an inner layer of material, said inner layer of material having a top portion of inner layer of material, a bottom portion of inner layer of material, a right side of inner layer of material, and a left side of inner layer of material, said outer layer of material being substantially peripherally attached to said inner layer of material to form said compartment;

said left side of inner layer of material has a left male component of an attaching mechanism and a left female component of an attaching mechanism, and said right side of inner layer of material has a right male component of an attaching mechanism and a right female component of an attaching mechanism, attachment of respective attaching mechanisms substantially restrains excessive movement of said compartment during physical activity, wherein valuable articles may be secretly stored in a secure and stable fashion.

* * * * *